United States Patent [19]

Grigorenko et al.

[11] 4,202,174

[45] May 13, 1980

[54] HYDRAULIC DRIVE

[76] Inventors: Anatoly S. Grigorenko, ulitsa Tovstukho, 1, kv. 21; Jury A. Moroz, ulitsa Fugenfirova, 11, kv. 91; German N. Kuznetsov, ulitsa Romanenko, 8, kv. 46; Vladimir I. Vimba, ulitsa 50 let VLKSM, 4-v, kv. 55; Vladimir V. Landyshev, ulitsa 50 let VLKSM, 14-a, kv. 22, all of Omsk; Jury A. Bocharov, 15 Parkovaya, 18, korpus 1, kv. 109; Anatoly V. Safonov, Sevastopolsky prospekt, 51, korpus 1, kv. 11, both of Moscow, all of U.S.S.R.

[21] Appl. No.: 906,621

[22] Filed: May 16, 1978

[51] Int. Cl.[2] ..... F15B 1/02

[52] U.S. Cl. ..... 60/413; 91/5

[58] Field of Search ..... 60/413, 418, 591, 593; 91/4 R, 5

[56] References Cited

U.S. PATENT DOCUMENTS

| | | | |
|---|---|---|---|
| 706,688 | 8/1902 | Reynders et al. | 91/4 X |
| 3,100,965 | 8/1963 | Blackburn | 60/413 X |
| 3,564,842 | 2/1971 | Van Marle | 60/593 X |

FOREIGN PATENT DOCUMENTS

| | | | |
|---|---|---|---|
| 161632 | 3/1964 | U.S.S.R. | 60/416 |

*Primary Examiner*—Edgar W. Geoghegan
*Attorney, Agent, or Firm*—Fleit & Jacobson

[57] ABSTRACT

A hydraulic drive according to the invention comprises a gas hydraulic accumulator and a chamber whose volume is equal to at least the consumption of fluid by a User, e.g. a hydraulic cylinder of a press. This chamber is divided by a piston into two spaces. One of these communicates with the accumulator through a pipeline which is connected to a pump. The other space of the chamber communicates with the pump through a non-return valve, and with the User, through a closing device. This layout of the hydraulic drive steps up its reliability and ensures the possibility of controlling the pressure in the gas-hydraulic accumulator.

3 Claims, 1 Drawing Figure

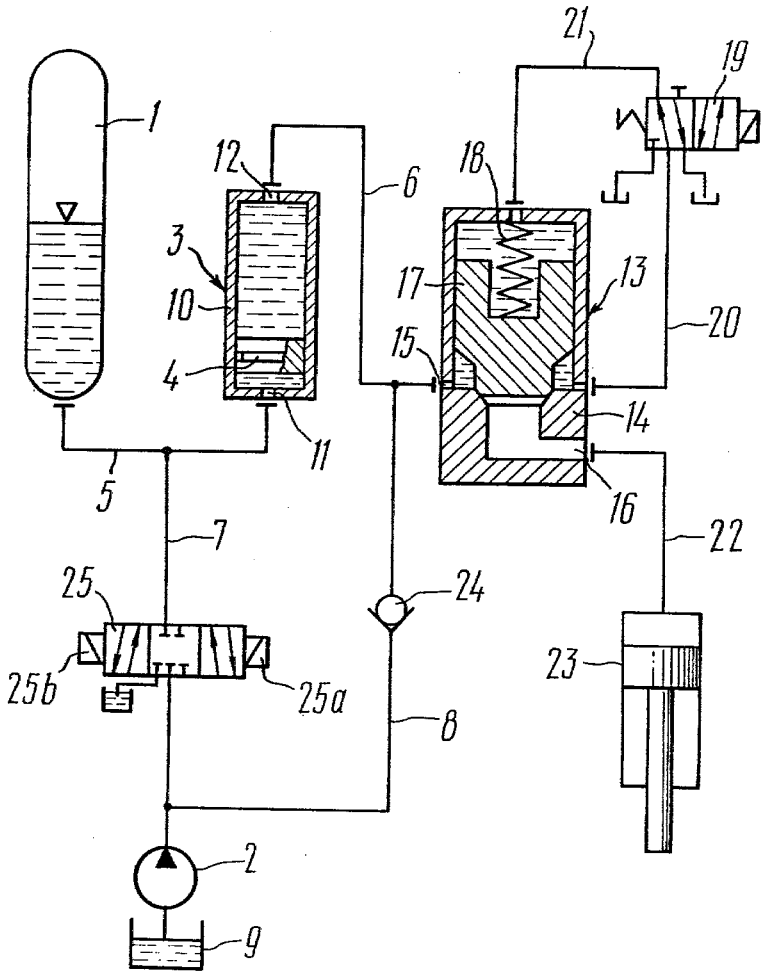
1
2
3
4
5
6
7
8
9
10
11
12
13
14
15
16
17
18
19
20
21
22
23
24
25
25a
25b

HYDRAULIC DRIVE

FIELD OF THE INVENTION

The present invention relates to a hydraulic drive and can be utilized in presses and power hammers; the invention will prove particularly useful in hydraulic screw presses.

BACKGROUND OF THE INVENTION

Known in the prior art are hydraulic drives comprising a gas-hydraulic accumulator communicating via a distributing device with the User, e.g. the space of the hydraulic power cylinder of a press. To make up for the used-up fluid such a hydraulic drive is provided with a pump intended to transfer fluid from a reservoir into the accumulator.

A disadvantage of the prior-art hydraulic drive consists in the necessity of checking the fluid level in the accumulator.

The absence of means for controlling the fluid level in the accumulator results in variations in said level and, as a consequence, in variations of the initial pressure in the hydraulic cylinder. A considerable rise of this level may bring about an emergency build-up of pressure whereas dropping of the level may permit gas to penetrate into the User's hydraulic system, e.g. hydraulic cylinder of the press, which will endanger the servicing personnel.

SUMMARY OF THE INVENTION

An object of the present invention is to eliminate the variations in the fluid level and pressure in the gas-hydraulic accumulator of a hydraulic drive.

Another object of the present invention is to provide a possibility of adjusting pressure in the hydraulic drive.

Still another object of the present invention is to improve the reliability of the hydraulic drive.

Among the other objects of the invention, an improvement in the safety of the servicing personnel is worthy of note.

BRIEF DESCRIPTION OF THE INVENTION

These and other objects are accomplished by providing a hydraulic drive which, according to the invention, has a fluid-filled chamber whose volume is equal to at least the fluid consumption by the User and which is divided by a piston into two spaces, one of which is communicated with the accumulator by means of a pipeline provided with a pump, while the other space of the same chamber communicates through a pipeline and a nonreturn valve with the pump and, through a controllable closing device, with the User.

An advantage of the claimed hydraulic drive consists in that, owing to said connection of the accumulator and chamber which has an accurately defined piston stroke, the accumulator receives one and the same amount of fluid at each working cycle of a given User. This guarantees a constant fluid level in the charged accumulator, and a constant initial pressure.

Besides, the provision of the piston in the chamber prevents the gas from the accumulator penetrating into the User's hydraulic system.

To facilitate operation, the pump is connected to the pipeline between the accumulator and the chamber through a distributing device which ensures the delivery of fluid from the reservoir into, and discharge of said fluid from, the accumulator.

An advantage of such a connection consists in that it permits changing the volume of fluid in the accumulator; this results in changing the volume of gas and, as a consequence, permits control of pressure in the accumulator.

BRIEF DESCRIPTION OF THE DRAWING

Now the invention will be described in detail by way of example with reference to the accompanying drawing which gives a schematic outline of the hydraulic drive according to the present invention.

DETAILED DESCRIPTION OF THE INVENTION

It can be seen in the drawing that the claimed hydraulic drive comprises a hydraulic accumulator 1, a pump 2, a chamber 3 with a movable piston 4, and pipelines 5, 6, 7 and 8 which connect the above-mentioned elements according to the present invention as will be considered in detail hereinbelow.

Besides, the hydraulic drive comprises a storage reservoir 9 holding the fluid delivered by the pump 2.

The gas-hydraulic accumulator can be constituted by any known type of accomulator whose internal space holds a certain preset volume of gas and a certain amount of fluid.

The chamber 3 has a cylindrical shell 10 possessing a required strength margin to suit the working pressure of the service fluid. This shell has holes 11 and 12 for admitting the fluid into, and discharging it from, the chamber. The chamber 3 is divided inside by a piston 4 into two spaces whose volume is determined by the position of the piston so that the chamber 3 is, virtually, a piston accumulator with two fluid-filled spaces. The full volume of the chamber 3 and of the fluid it contains, taking into account the size of piston 4, should be equal to at least the volume of the working cylinder of the press (not shown in the drawing) utilizing the claimed hydraulic drive.

Connected to the hole 11 is the pipeline 5 which communicates the chamber 3 with the accumulator 1, while the hole 12 is connected to the pipeline 6 for communicating the chamber 3 with the closing device 13. The closing device 13 consists of a body 14 with holes 15 and 16, and a valve 17 with a compression spring 18. The closing device 13 is controlled by an electromagnetic two-way slide-valve distributor 19 which is connected to said device 13 by two pipelines 20 and 21.

Connected to the hole 15 is the pipeline 6, while the hole 16 is connected with the pipeline 22 leading to the hydraulic cylinder 23 of the press (not shown in the drawing).

The pipeline 8 is connected to the pipeline 6 and incorporates a nonreturn valve 24.

In the pipeline 7 communicating the pump 2 with the pipeline 5 is mounted a three-way electromagnetic slidevalve distributor 25.

The claimed hydraulic drive functions as follows.

In the initial position all the elements of the drive occupy the positions shown in the drawing.

As the electromagnet of the distributor 19 is energized, the distributor is shifted to a position in which it puts the above-valve space in communication with the reservoir 9 through the pipeline 21.

The valve 17 is lifted by fluid pressure from its seat and opens communication of the fluid between the holes 15 and 16. Thus the closing device 13 controls the supply of service fluid from the upper, above-piston space of the chamber 3 into the press cylinder 23 through the hole 12 and pipelines 6 and 22.

The fluid is forced out of the chamber 3 by the piston 4 whose lower end is acted upon by the force of the fluid entering the hole 11 from the accumulator 1 through the pipeline 5.

Thus, the fluid enters the working cylinder only from the upper space of the chamber 3 and this space is isolated by the piston 4 both from the lower space of the chamber and from the accumulator 1. This ensures safety in emergency situations, for example when the hydraulic system of the press becomes leaky. In this case the accumulator will not be completely discharged because the travel of the piston 4 is limited by the upper part of the chamber 3.

Besides, gas is prevented from penetrating the hydraulic system of the press from the accumulator 1.

During normal operation of the hydraulic drive with the hydraulic cylinder 23 of the press, the fluid is consumed from the upper space of the chamber 3 and the pressure in the accumulator 1 drops from the initial value to a certain lower level.

On completion of the working stroke of the press cylinder 23 the electromagnet of the distributor 19 is deenergized and the distributor is shifted to the initial position shown in drawing in which the space above valve 17 is put in communication through the pipelines 21 and 20 with the undervalve space so that the spring 18 forces the valve 17 down on its seat. The hydraulic cylinder 23 is then cut off from the hydraulic drive.

Then the pump delivers the service fluid from the reservoir 9 through the pipeline 8, the nonreturn valve 24 and the pipeline 6 into the upper space of the chamber 3.

The force of the fluid applied to the upper side or end of the piston 4 lowers said piston thus forcing the fluid out of the lower space of the chamber 3 through the hole 11 and pipeline 5 into the accumulator 1 wherein pressure rises to the initial valve. It should, certainly, be understood that the pressure built up by the pump must be higher than the initial pressure in the accumulator 1.

In the downmost position the end of the piston 4 comes to bear against the bottom of the chamber 3 so that further pressure rise in the accumulator proves to be impossible.

Thus pressure in the accumulator is prevented from rising higher than the preset initial pressure.

If the initial pressure in the accumulator has to be raised, it is necessary to energize the right-hand (in the drawing) electromagnet **25*a* of the distributor 25. In this case the distributor 25 will occupy such a position in which the pump 2 delivers an additional amount of fluid into the accumulator 1 from the reservoir 9 through the pipelines 7 and 5**.

If the initial pressure in the accumulator 1 has to be decreased, it is necessary to energize the left-hand electromaget **25*b* (in the drawing) of the distributor 25. Then the distributor moves to a position in which the accumulator 1 is connected through the pipelines 5 and 7 with the reservoir 9. The fluid is forced by the pressure of gas out of the accumulator 1 into the reservoir 9. Inasmuch as the volume of fluid in the accumulator decreases and the volume of gas increases, the initial pressure drops. As the preset pressure is reached, the electromagnet of the distributor 25** is deenergized and the distributor returns to the initial position.

It should be borne in mind that the above-described device with electromagnetically-controlled elements must have an electronic control unit which, however, is not illustrated in the drawings since it is well known to those skilled in the art. Any unit ensuring the above-mentioned operations of energizing and deenergizing the electromagnets can be utilized in the claimed hydraulic drive.

While a specific embodiment of the invention has been disclosed in the description, it will be understood that various modifications and changes within the spirit and the scope of the invention may occur to those skilled in the art.

These changes and modifications can be resorted to without departing from the function or the scope of the present invention, as set forth in the claims which follow.

We claim:

1. A hydraulic drive comprising a gas-hydraulic accumulator in the form of a container filled with a service fluid and gas for maintaining a preset pressure in said container, a reservoir holding a supply of service fluid, a pump for transferring the service fluid from said reservoir, a chamber for the service fluid whose volume is equal to at least the consumption of fluid by a working stroke of a device utilizing said drive, said chamber being divided by a piston into two spaces, a first pipeline for communicating said accumulator with one space of said chamber, a second pipeline adapted for communicating the other space of said chamber with the device utilizing said drive, said second pipeline being provided with a closing device for cutting off the supply of fluid to the device, a distributing device for controlling the opening and closing of said closing device, a third pipeline for communicating said pump with said other space of the chamber, a nonreturn valve installed in said third pipeline, a fourth pipeline communicating with said first pipeline and with the pump and intended to supply the service fluid from the reservoir into the accumulator.

2. A hydraulic drive according to claim 1 wherein the pump is connected to said first pipeline between the accumulator and the chamber through a distributing device in the form of a three-way slide valve which controls the delivery of fluid from the pump to the accumulator, and its discharge from the space of the accumulator.

3. A hydraulic drive according to claim 2 wherein the distributing device comprises an electromagnetic three-way slide valve.

* * * * *